United States Patent [19]

Cumbers

[11] 4,170,680

[45] Oct. 9, 1979

[54] NON-WOVEN FABRICS

[75] Inventor: David C. Cumbers, Harrogate, England

[73] Assignee: Imperial Chemical Industries Limited, London, England

[21] Appl. No.: 882,153

[22] Filed: Feb. 28, 1978

Related U.S. Application Data

[62] Division of Ser. No. 568,836, Apr. 17, 1975, Pat. No. 4,088,726.

[30] Foreign Application Priority Data

| | | | |
|---|---|---|---|
| Apr. 26, 1974 | [GB] | United Kingdom | 18369/74 |
| Sep. 20, 1974 | [GB] | United Kingdom | 41066/74 |
| Feb. 7, 1975 | [GB] | United Kingdom | 5282/75 |

[51] Int. Cl.[2] ..... B32B 3/00; D04H 5/06; D04H 3/14; D04H 1/54

[52] U.S. Cl. ..... 428/195; 428/288; 428/296; 428/297; 428/373

[58] Field of Search ..... 428/195, 198, 225, 288, 428/296, 297, 373; 156/166, 180, 181

[56] References Cited

U.S. PATENT DOCUMENTS

| | | | |
|---|---|---|---|
| 3,542,634 | 11/1970 | Such et al. | 428/198 |
| 3,595,731 | 7/1971 | Davies et al. | 428/296 |

*Primary Examiner*—James J. Bell

*Attorney, Agent, or Firm*—Cushman, Darby & Cushman

[57] ABSTRACT

A thermally segmentally bonded non-woven fabric having an attractive pattern of irregular bonds and a process for preparing it using heated patterned calender rolls having thereon surface patterns of lands with depressions between, one consisting of continuous lands and the other of isolated projections arranged in a particular way so that lands which oppose each other in the nip overlap to different extents.

8 Claims, 7 Drawing Figures

NON-WOVEN FABRICS

This is a division, of application Ser. No. 568,836 filed Apr. 17, 1975 now U.S. Pat. No. 4,088,726.

This invention relates to non-woven materials, in particular to segmentally bonded non-woven fabrics having excellent drape and other properties and to processes for their production.

Many methods for the production of bonded non-woven fabrics have been proposed including the application to a non-woven web of adhesives or heat if thermoplastic materials are included in the web. In particular it is known to apply heat and pressure for bonding at limited areas of the web by passing it through the nip between calender rolls at least one of which is heated and carries a pattern of lands and depressions on its surface. Where the fabric is nipped between the roll surfaces heavy or primary bonding is effected at separated segments of the fabric resulting in a segmentally bonded fabric. Of the roll pair used as the calender rolls either one roll or both rolls may carry patterns of lands and depressions in the former case the second roll being a plain unpatterned one. In the former case the roll especially when directly heated also tends to cause some less heavy or secondary bonding over the remainder of the fabric where it has not been nipped between the rolls. This overall secondary bonding on one face of the fabric tends to stiffen the fabric. In the latter case when both rolls are patterned it is known to use patterns in the form of circumferential rings or helices or longitudinal splines which can not intermesh. Calendering with such rolls does not cause secondary bonding over the whole of a fabric face but only at those places in each face where the fabric has been touched by a land on one side only. However this more limited secondary bonding is achieved at the expense of the disadvantage that only a limited range of regular patterns of primary bonds can be produced, at the land cross over points as the rolls rotate.

Calendering a web between two rolls each bearing patterns of lands which were maintained sufficiently accurately in register with each other could produce any desired pattern of both primary and secondary bonding; but maintenance of such accurate register is not practicable, or is at best very expensive, when using rolls big enough to produce wide fabrics and with lands small enough to produce fabrics with useful properties and pleasing appearance.

The optimum physical and visual properties of the bonded fabric are directly or inversely related to the amount of bonding and accordingly the properties obtained in a fabric are the result of a compromise. Hitherto available fabrics have not achieved the best combination of properties for all purposes, in particular as fabrics for apparel purposes where properties closely resembling conventional woven and knitted fabrics and an attractive appearance are desired. Such known fabrics generally carried a geometrically regular pattern of primary bonds which is aesthetically unattractive.

We have now produced an aesthetically attractive segmentally bonded fabric and a new method of making it which overcomes or greatly reduces these various problems of excessive secondary bonding, pattern limitation, poor aesthetics and engineering feasibility.

According to this invention we provide a non-woven fabric comprising a web of fibres which includes distributed thermoplastic material, having on each face patterns of bonded areas at least some of which in one face overlap bonded areas on the opposite face, the material of the web between opposed portions of bonded areas being depressed and formed into coherent bonds and the bonded areas on at least one face being discrete discontinuous areas distributed over this face the fibres in the bonded areas being bonded by the thermoplastic material.

Also according to this invention we provide a method of making a thermally segmentally bonded fabric by passing a web comprising at least some distributed thermally bondable material through the nip between co-operating calender rolls at least one of which is heated and which have different surface land patterns, wherein some irregularity of bond pattern is provided by the surface pattern on one roll consisting of lands which are continuous, as hereinafter defined, and the surface pattern on the other roll consisting of lands which are isolated projections and the centroids of area of those projections concurrently in the nip being disposed at differing distances from the longitudinal axis of the nearest continuous land surface so that lands which oppose each other in the nip overlap to different extents.

In a preferred method according to the present invention the isolated projections are also arranged so that there are rows of neighbouring projections in close or overlapping echelon along directions inclined to the line of the nip. This arrangement of projections serves to break up bond pattern regularity in a second direction on the fabric surface, and in the case of ring or helix lands removes any possibility of "chatter" as the rolls rotate. Of course when the continous lands are longitudinal splines it is not possible to remove the phenomenon of "chatter" which can only be minimised by minimising the spacing between the splines and/or increasing the roll diameter.

By the words "continuous land" herein is meant a land which extends around substantially the full circumference or along substantially the full length of a roll. Such lands may for example, be formed as circular or elliptical rings, as helices or a longitudinal splines.

The interaction of lands on one calender roll with opposed lands on the other roll of the pair for simplicity is described herein with reference to the line of the nip. This is of course not a static situation and this line is continually moving as the rolls rotate. In practice with rolls having a diameter of a few inches to one foot or more pressure in the nip will be applied at any instant over a finite circumferential width of nip which will include several lands in the circumferential direction. Thus in operation the interaction of opposed lands may be more complicated than herein described for the static situation and a nip line lacking finite width. Fluctuations in relative register between the rolls due to backlash and other mechanical inconsistences in the calender mechanism will cause increases in the overlapping areas between some opposed land pairs and decreases in overlapping areas between other opposed land pairs. The resulting bond pattern changes due to such fluctuations will go substantially unnoticed by reason of the variability of patterning inherent in a product of this invention.

In a further preferred method according to this invention the distances from the centroids of the projections to the longitudinal axes of the continuous lands range from zero to a half of the spacing between adjacent continuous lands so that the rolls cannot intermesh whatever their mutual register as a whole and so that the pattern of primary bonds formed in a fabric contains some large bonds resulting from fully facial contact between some lands, and some very small bonds resulting from only glancing contact between other lands. This kind of primary bond pattern provides a visually interesting fabric texture which is substantially not visibly altered by any fluctuations in relative register between the rolls.

Fibrous webs for use in this invention may comprise staple fibres or continuous filaments or mixtures of these. Staple fibre webs are conveniently prepared by carding a mass of staple fibres and continuous filament webs may be prepared by a conventional air laying method using a jet of air to transport the filaments from some source and to spread them in a random array on a foraminous conveyor. An electrostatic charge may be applied to the filaments to enhance their separation prior to laying on the conveyor. Staple fibre webs may be prepared from conventional crimped fibres and satisfactory bonded webs are made therefrom. However we have found that a bonded product having enhanced physical properties, in particular tensile and tear strengths, may be produced by applying a process according to this invention to a web of uncrimped staple fibres. The absence of crimp in the staple fibres adversely affects the uniformity of a web made by carding only but this difficulty may be reduced or overcome by treating the fibres before carding with a coating which enhances the interfibre friction as for example a lubricating mixture including particles of an inert solid such as silica. Alternatively the web may be produced by a carding operation followed by a random air laying process or directly by a random air laying process. A suitable machine for carrying out the air laying process is the Rando-Webber made by the Curlator Corporation in which the fibres are twice dispersed in a stream of air and laid as a web on a foraminous conveyor which separates them from the air. The final web is essentially anisotropic unlike a carded web in which fibres exhibit a preponderant orientation in the machine direction.

A thermoplastic material included in a web used in this invention may comprise particles of the material distributed throughout the web of fibres or it may take the form of distributed fibres of lower softening or melting point than the other web fibres or thirdly the web may consist wholly or in part of bicomponent fibres one of the components being at least in part present at the surface of the fibres and being of lower softening or melting point than the other component. The fibres of a web may include natural or artificial fibres or synthetic fibres spun from linear organic polymeric materials as for example melt spinnable polyesters, polyamides and copolymers of these classes of organic linear polymers.

In a process according to this invention both patterned rolls may be rigid or one or both may have some inherent compliance or limited flexibility to accommodate and equalise small pressure differences along the roll, in which case a rigid back up roll operating against the compliant roll may be necessary.

Isolated projections making up the pattern of lands on one roll of a pair of calender rolls may have various forms, as for example, small points with flat or slightly domed tip surfaces and of square, rectangular, circular or other cross-sectional shape having a cross-sectional area at the tips of a few tenths or hundredths of a square millimeter. The projections may be formed on the roll surface by an appropriate machining operation or by etching. Continuous lands, which may have a width of from 0.1 to 1 mm, are most readily formed by machining on a lathe or milling machine or by knurling. If the spacing of lands is not the same on each roll then the differing relative disposition of opposed land surfaces may be achieved by selecting the size and disposition of the pattern of isolated projections. If the spacing of lands is the same then skewing of one pattern relative to the other by a small angle is the simplest way to achieve the differing relative disposition of opposed lands. This method also has the advantage that the primary bond pattern impressed on a fabric may be radically changed simply by machining one pattern at different angles of skew.

By utilising a differing relative disposition of opposed land surfaces according to this invention the set or regular patterns of segmental bonds characteristic of the prior methods wherein the bonds are also of substantially regular size and shape, are replaced by a pattern of bonded areas, particularly of primary bonds which are not regular in shape or area, in which the regular pattern of lands on each calender roll is broken up and not recognisable in the overall pattern in the resulting bonded fabric. As a result the centroids of area of those bonded areas immediately adjacent any imaginary straight line across the fabric will differ in their distances therefrom. This accommodates changes in the relative register of opposed land portions on the rolls during their rotation, due to backlash in gearing or other mechanical inconsistencies, by obscuring the resulting bond area changes in the overall bond pattern irregularity and results in a fabric of pleasing and attractive appearance having good hand and drape properties.

A fabric bonded according to this invention will exhibit on both faces patterns of strongly bonded segments formed where opposed land surfaces overlie in the nip and patterns of comparatively weakly bonded areas where the web has been in contact on one face only with a heated land, the heat being sufficient to produce some interfusing of contiguous fibre segments. Such weaker bonds may not be readily apparent to the naked eye but are readily detected by microscopic examination. For convenience herein the strongly bonded segments are referred to as primary bonds and the weakly bonded areas as secondary bonds. In addition there will be present in the fabrics substantially completely unbonded areas which have not been in contact with a land on either roll. The visual differences between the three classes of area on a bonded fabric surface may be enhanced by superficial metallisation of the fabric surface.

To exhibit the optimum properties, particularly tactile and drape properties, fabrics after bonding may require light mechanical working, as for example the bending and flexing applied by scouring or dyeing of the fabric in rope form. Fabrics made from blends of some fibres, in particular blends of bicomponent and monocomponent synthetic polyamide or polyester fibres, in the greige state immediately after bonding exhibit excellent tactile properties without the need for any light mechanical treatment and the processing of such fabrics may in consequence be simplified.

The invention is illustrated in the accompanying drawings wherein.

Figure 1:
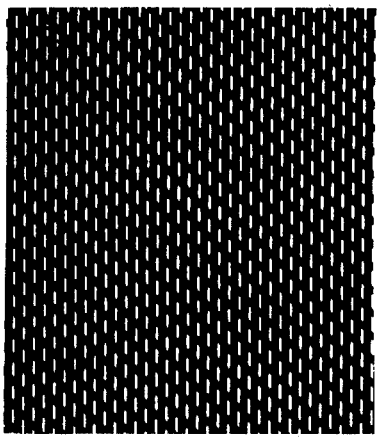
FIG. 1 Illustrates a pattern of lands on a calender roll having the form of parallelogram-shaped isolated projections arranged in close echelon.
Figure 2:
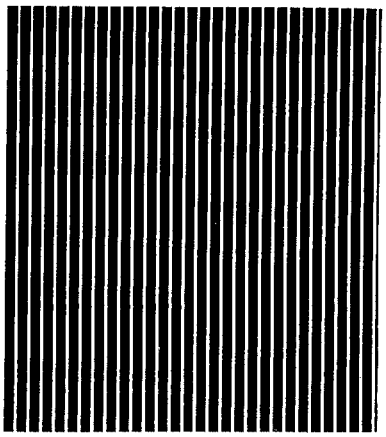
FIG. 2 Illustrates a pattern of continuous lands on a calender roll comprising a series of uniformly spaced circumferential rings.
Figure 4:
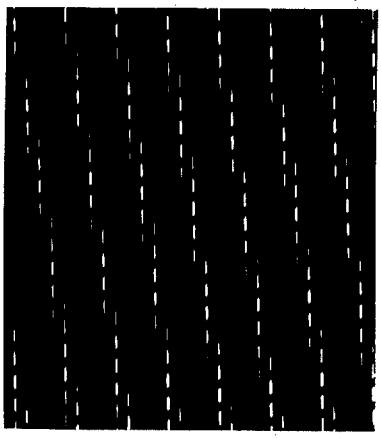
FIG. 4 Illustrates one face of a bonded fabric of the invention showing the pattern of primary bonds obtained by passage through a pair of calender rolls, one as in FIG. 1 and the other as in FIG. 2, one pattern being skewed at an angle of 2° with respect to the other.
Figure 5:
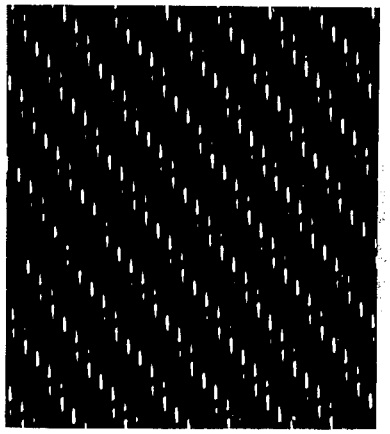
FIG. 5 Illustrates a fabric bonded between rolls as in FIG. 4 but with a skew angle of 8°.
Figure 3:
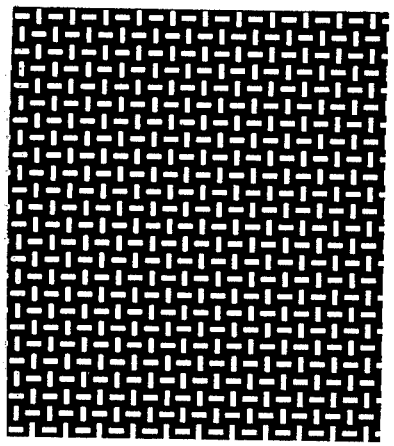
FIG. 3 Illustrates a pattern of lands on a calender roll which is made by etching.
Figure 6:
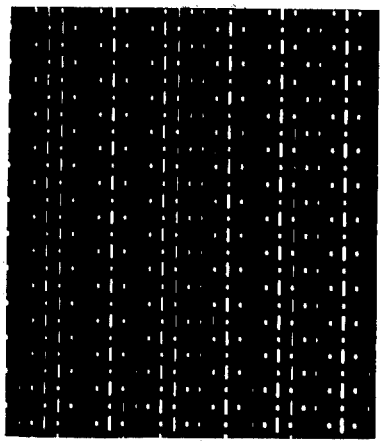
FIG. 6 Illustrates one face of a fabric bonded by passage between a FIG. 2 roll and a FIG. 3 roll the patterns of lands each being lined up axially and circumferentially on its roll.

In these drawings white areas represent lands in FIGS. 1-3 and primary bonds in FIGS. 4-6. All drawings are substantially full size.

Referring now to the primary bond patterns illustrated in FIGS. 4 and 5 the greater breaking up of the lines pattern of FIG. 2 by using a larger skew angle is immediately apparent. Also seen in both FIGS. 4 and 5 are the differing bond areas along any imaginary nip line (the machine direction being down the paper) brought about by the differing relative disposition of opposed projection/land pairs.

FIG. 6 illustrates a pattern of primary bonds of different areas obtained by selection of the respective bond patterns without the use of skewing.

Figure 7:
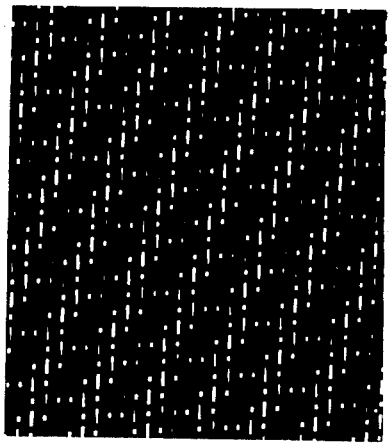
FIG. 7 Illustrates one face of a fabric bonded between rolls as in FIG. 6 but with a skew angle of 5°.

FIG. 7 illustrates the superimposed effects of pattern selection as in FIG. 6 and skewing of one pattern relative to the other by a small angle.

The invention is further illustrated in the following Examples wherein crimp ratio is calculated from the relation:

$$\frac{\text{extended length} - \text{crimped length}}{\text{crimped lemgth}} \times 100$$

Drape coefficient is measured according to the method of Cusiok, J Text Inst. 1968, 59, T253.

Some properties are measured in two directions, the longitudinal or machine direction and the transverse or cross direction and these are respectively indicated as MD and CD in the following Examples.

EXAMPLE 1

Freshly melt spun filaments of sheath core bicomponent form, in which the sheath is nylon 6 and the core nylon 66 in the proportion 35:65 by weight, are partially drawn and sprayed by means of an air ejector onto a foraminous conveyor, the air ejector being traversed laterally across the conveyor to produce a randomly laid web having a weight of 70 g/m$^2$ in which the filaments have a tenacity of 2.5 g/decitex, an extension at break of 120% and a decitex of 4.

The web is then treated at a speed of 7.5 m/min by heat and pressure in the nip between calender rolls 1 meter wide both heated to a temperature of 200° C. and being urged together at a nip pressure of 20 Kg/cm and both carrying a surface pattern of lands one continuous and the other discontinuous, with depressions between. The pattern of discontinuous lands on one roll are of the form illustrated in FIG. 3 wherein the tip faces of each land measure 2.64×0.90 mm, are spaced apart at the tips axially and longitudinally by 1.28 mm and the lands are 1.0 mm deep. The diameter of this roll is 195 mm. The pattern of continuous lands are in the form of splines measuring 0.38 mm wide at the face and 0.73 mm deep separated at the faces by 1.42 mm. The latter roll also possesses some compliance to equalise nip pressure by being formed of a steel tube of wall thickness 13 mm and outside diameter 127 mm. The pattern of discontinuous lands on the upper roll are lined up axially and circumferentially and the splines on the lower roll are axially parallel.

The conditions in the nip cause the sheath component of the filaments to become adhesive whilst the core component is substantially unaffected and on cooling primary and secondary bonds are formed between contiguous filaments with a pattern of primary bonds resembling FIG. 6. The product has a pleasing appearance, excellent drape after washing and the properties shown below before and after a simple wash at 60° C. in water:

| Property | | Greige state | After washing |
|---|---|---|---|
| Area weight g/m$^2$ | | 73 | 84 |
| Drape coefficient, % | | 73 | 27 |
| Breaking strength, Kg/g/cm | MD | 356 | 286 |
| | CD | 411 | 386 |
| Extension at break, % | MD | 61 | 48 |
| | CD | 75 | 74 |
| Tear strength, g/g/m$^2$ | MD | 38 | 31 |
| | CD | 29 | 27 |

MD - Measured in the machine direction
CD - Measured transverse to the machine direction.

EXAMPLE 2

Polyester bicomponent filaments having a core of 0.65 intrinsic viscosity (IV) poly(ethylene terephthalate), the IV being measured at 25° C. in solution in O-chlorophenol and a sheath of a 15 moles % ethylene isophthalate/terephthalate copolyester (IV 0.55), the components being present in the proportion 2:1, core to sheath, are melt spun, drawn to a decitex of 3.3, mechanically crimped in a stuffer box crimper to 3.5 crimps/cm at a crimp ratio of 34 and cut into 50 mm lengths. The staple fibres thus produced are blended with an equal weight of staple fibres of poly(ethylene terephthalate) of 0.63 IV, 3.3 decitex, 50 mm length, 3.5 crimps/cm and crimp ratio 34% and formed into a web weighing 142 g/m$^2$ by means of conventional air deposition equipment (the Rande-Webber manufactured by Curlator Corporation). The web is lightly consolidated by needle punching with 36 gauge 5 barb needles arranged in a random pattern in a needle board, the needles penetrating the web to a depth of 4 mm. The web is passed through the needle loom at a rate which ensures about 46 needle penetrations per square centimeter.

The web is then calendered at a speed of 3 m/min between patterned rolls as used in Example 1 each heated to a temperature of 195° C. and urged together to give a nip pressure of 31 Kg/cm.

The segmentally bonded fabric in its greige state has the following properties:

| | | |
|---|---|---|
| Area weight, g/m$^2$ | | 42 |
| Drape coefficient % | | 79 |
| Breaking strength g/g/cm. | MD | 60 |
| | CD | 138 |
| Extension at break % | MD | 19 |

-continued

| | | |
|---|---|---|
| | CD | 62 |
| Tear strength, g/g/m$^2$ | MD | 12 |
| | CD | 11 |

EXAMPLE 3

A lightly consolidated web weighing 133 g/m$^2$ is prepared as described in Example 2 from a blend of equal weights of wool and bicomponent polyamide staple fibres of the same composition as the filaments of Example 1 having a decitex of 3.3, a length of 100 mm, 5.3 crimps/cm and a crimp ratio of 20%.

The web is then calendered at a speed of 3 m/min between patterned rolls, both heated to a temperature of 217° C. and urged together at 31 Kg/cm nip pressure. One roll carries a FIG. 3 pattern of isolated lands as described in Example 1 and the other a helical thread (left hand) having 14 threads per inch (5.2 threads per cm) of substantially square form and of 0.32 mm land width. The latter roll is a compliant steel tube of 127 mm and 112.5 mm inside and outside diameters respectively.

The segmentally bonded fabric produced, in its greige state has the following properties:

| | | |
|---|---|---|
| Area weight, g/m$^2$ | | 133 |
| Drape coefficient, % | | 77 |
| Breaking strength, g/g/cm | MD | 132 |
| | CD | 67 |
| Extension at break % | MD | 27 |
| | CD | 54 |
| Tear strength, g/g/m$^2$ | MD | 1.5 |
| | CD | 7.5 |

EXAMPLE 4

A lightly consolidated web, weighing 122 g/m$^2$, is prepared as described in Example 2 from nylon 6 staple fibres having a decitex of 6.7, a length of 72.5 mm, 11.6 crimps/cm and a crimp ratio of 24%.

The web is then calendered at a speed of 3 m/min between patterned rolls both heated to a temperature of 200° C. and urged together at 31 Kg/cm nip pressure. The lower compliant roll carries a pattern of splines as in Example 1 and the upper roll of 195 mm diameter carries a closed echelon arrangement as in FIG. 1 of parallelogram shaped lands measuring 3.22 mm and 0.84 mm in the circumferential and axial directions respectively and spaced apart by 0.58 mm and 0.71 mm circumferentially and axially respectively, the longer dimension of the lands extending substantially perpendicular to the roll axis.

The segmentally bonded fabric produced in its greige state, has the following properties:

| | | |
|---|---|---|
| Area weight, g/m$^2$ | | 122 |
| Drape coefficient, % | | 73 |
| Breaking strength, g/g/cm | MD | 93 |
| | CD | 103 |
| Extension at break, % | MD | 16 |
| | CD | 34 |
| Tear strength, g/g/m$^2$ | MD | 5.2 |
| | CD | 3.7 |

EXAMPLE 5

A lightly consolidated web, weighing 129 g/m$^2$ is prepared as described in Example 2 from a blend of equal weights of nylon 6 and nylon 66 staple fibres. The nylon 6 fibres are as used in Example 4 and the nylon 66 fibres have a decitex of 3.3, a length of 51 mm, 5 crimps per cm and a crimp ratio of 18%.

The web is calendered at a speed of 3 m/min between patterned rolls as used in Example 4 at the same roll temperatures and nip pressure.

The segmentally bonded fabric produced in its greige state, has the following properties:

| | | |
|---|---|---|
| Area Weight, g/m$^2$ | | 129 |
| Drape coefficient, % | | 79 |
| Breaking strength, g/g/cm | MD | 151 |
| | CD | 211 |
| Extension at break, % | MD | 29 |
| | CD | 24 |
| Tear strength, g/g/m$^2$ | MD | 12.9 |
| | CD | 6.9 |

The foregoing Examples all employed rolls of 1 meter length but other roll lengths and diameters or two rigid rolls are equally applicable in a process according to this invention.

The percentage of the fabric area occupied by primary bonds, calculated as the product of the % area of each roll surface occupied by lands is shown below together with the ratio of land area on the rolls:

| Example | Land Areas, % | Primary Bond Area % | Ratio of Land Areas |
|---|---|---|---|
| 1 | 25 and 21 | 5.3 | 1.2 |
| 2 | 25 and 21 | 5.3 | 1.2 |
| 3 | 25 and 18 | 4.5 | 1.4 |
| 4 | 46 and 21 | 9.7 | 2.2 |
| 5 | 46 and 21 | 9.7 | 2.2 |

High bond areas tend to produce stiffer fabrics and low bond areas to produce less coherent fabrics. Furthermore the same primary bond area can be produced by rolls with equal land areas or by rolls with unequal land areas which cause greater secondary bonding on one face, increasing fabric stiffness, and at the same time less secondary bonding on the other face, reducing resistance of the fabric to abrasion and pilling.

It is therefore preferable to use equal land areas giving fabrics with balanced bonding on the two faces. However, strict adherence to balanced bonding causes unnecessary restriction on choice of patterns, and proves to be unnecessary. Different end uses also present different criteria for fabric performance. In general it is preferable to use pairs of rolls for which the product of the land areas is between 2% and 20%, even more preferably between 5% and 12%; and for which the ratio of land areas is less than 5 to 1.

In the foregoing description processes using calender rolls for impressing patterns of bonded areas on a web have been described. However, the less satisfactory compressing of a web in sections between the platens of a press could also be used without departing from the spirit of this invention but such alternatives are generally slow and less convenient to operate.

What we claim is:

1. A non-woven fabric comprising a web of fibres which includes distributed thermoplastic material and which has been passed through a calender, said fabric, having on each face patterns of bonded areas at least some of which in one face overlap bonded areas on the opposite face, the material of the web between opposed portions of bonded areas being depressed and formed into coherent bonds, the coherently bonded areas varying in shape and area and together forming a pattern of bonded areas the centroids of area of those bonded areas immediately adjacent any imaginary straight line across the fabric differing in their distances therefrom, and the bonded areas on at least one face being discrete discontinuous areas distributed over this face, the fibres in the bonded areas being bonded by softening and resolidification of the thermoplastic material.

2. A fabric according to claim 1 wherein the web comprises staple fibres, continuous filaments or mixtures of these.

3. A fabric according to claim 1 wherein the web includes fibres or filaments made from a melt-spinnable synthetic organic polymer selected from the group consisting of polyesters and polyamides.

4. A fabric according to claim 1 wherein the fibres or filaments include bicomponent synthetic organic polymeric fibres wherein one component is present at least in part at the fibre surface and is of lower softening or melting point than the other component.

5. A fabric according to claim 1 consisting of a blend of mono-component synthetic staple fibres and bicomponent synthetic staple fibres.

6. A fabric according to claim 1 wherein the fibres include or consist of uncrimped synthetic organic staple fibres.

7. A fabric according to claim 1 wherein the web includes natural staple fibres.

8. A fabric as in claim 1 wherein the overlap of bonded areas on opposite faces of the fabric varies from negligibly small up to substantially the full area of the bonded area in one face.

* * * * *